US009111509B2

(12) United States Patent
Kim et al.

(10) Patent No.: US 9,111,509 B2
(45) Date of Patent: Aug. 18, 2015

(54) DISPLAY APPARATUS THAT GENERATES BLACK IMAGE SIGNAL IN SYNCHRONIZATION WITH THE DRIVER IC WHOSE INTERNAL CLOCK HAS THE HIGHEST FREQUENCY WHEN IMAGE/TIMING SIGNALS ARE NOT RECEIVED

(75) Inventors: Minki Kim, Gyeongbuk (KR); SungChul Ha, Paju-si (KR); JinSung Kim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 405 days.

(21) Appl. No.: 13/548,946

(22) Filed: Jul. 13, 2012

(65) Prior Publication Data

US 2013/0038597 A1 Feb. 14, 2013

(30) Foreign Application Priority Data

Jul. 14, 2011 (KR) ..... 10-2011-0069994

(51) Int. Cl.
*G09G 3/36* (2006.01)

(52) U.S. Cl.
CPC ..... *G09G 3/3688* (2013.01); *G09G 2310/061* (2013.01)

(58) Field of Classification Search
CPC ..... G09G 3/3275–3/3291; G09G 3/3685–3/3688; G09G 2310/027–2310/0275; G09G 2310/061; G09G 2300/0408; G09G 2330/02; G09G 2330/021; G09G 2330/022
USPC ..... 345/60–104, 204–215, 690–699
See application file for complete search history.

(56) References Cited

U.S. PATENT DOCUMENTS

| | | | | |
|---|---|---|---|---|
| 6,288,699 | B1 * | 9/2001 | Kubota et al. | 345/99 |
| 6,292,182 | B1 | 9/2001 | Park et al. | |
| 2005/0168429 | A1 * | 8/2005 | Chou | 345/100 |
| 2009/0096769 | A1 | 4/2009 | Kim et al. | |

(Continued)

FOREIGN PATENT DOCUMENTS

| | | | |
|---|---|---|---|
| CN | 1707595 | A | 12/2005 |
| CN | 101025483 | A | 8/2007 |

(Continued)

OTHER PUBLICATIONS

German Patent and Trademark Office, Office Action, German Patent Application No. 10 2012 106 352.4, Feb. 6, 2014, fourteen pages.

(Continued)

*Primary Examiner* — Chanh Nguyen
*Assistant Examiner* — Navin Lingaraju
(74) *Attorney, Agent, or Firm* — Fenwick & West LLP

(57) ABSTRACT

A flat panel display is provided. In particular, a flat panel display including a driving circuit in which a timing controller and a data driver for driving a panel are mounted in a single IC, and a driving circuit thereof are provided. The flat panel display includes a display panel having a plurality of pixels, a gate driver controlling the plurality of pixels, and a plurality of driving circuits processing and converting an image signal and outputting the same to a display panel in a normal mode. The driving circuits generate a black image signal according to a synchronization signal.

10 Claims, 7 Drawing Sheets

(56) References Cited

U.S. PATENT DOCUMENTS

| | | | | |
|---|---|---|---|---|
| 2009/0153541 | A1* | 6/2009 | Yusa | 345/213 |
| 2009/0167750 | A1* | 7/2009 | Hong et al. | 345/213 |
| 2009/0244052 | A1* | 10/2009 | Takahashi | 345/213 |
| 2010/0146175 | A1* | 6/2010 | Choe et al. | 710/110 |
| 2010/0148829 | A1* | 6/2010 | Hong et al. | 327/108 |
| 2010/0225637 | A1* | 9/2010 | Jeon et al. | 345/213 |
| 2010/0302214 | A1* | 12/2010 | Kim et al. | 345/204 |
| 2010/0302220 | A1* | 12/2010 | Baek et al. | 345/204 |
| 2011/0080382 | A1* | 4/2011 | Koo | 345/204 |
| 2011/0148850 | A1* | 6/2011 | Kadota | 345/213 |
| 2012/0086681 | A1* | 4/2012 | Kim et al. | 345/204 |
| 2012/0127137 | A1* | 5/2012 | Kim et al. | 345/204 |
| 2012/0127145 | A1 | 5/2012 | Jang et al. | |

FOREIGN PATENT DOCUMENTS

| | | | |
|---|---|---|---|
| CN | 101477779 | A | 7/2009 |
| DE | 10 2011 054 823 | A1 | 5/2012 |
| JP | H03-245686 | A | 11/1991 |

OTHER PUBLICATIONS

Chinese Office Action, Chinese Application No. 201210241776.3, Nov. 3, 2014, 12 pages.

State Intellectual Property Office of the People's Republic of China, Second Office Action, Chinese Patent Application No. 201210241776.3, Jun. 9, 2015, thirteen pages.

* cited by examiner

DISPLAY APPARATUS THAT GENERATES BLACK IMAGE SIGNAL IN SYNCHRONIZATION WITH THE DRIVER IC WHOSE INTERNAL CLOCK HAS THE HIGHEST FREQUENCY WHEN IMAGE/TIMING SIGNALS ARE NOT RECEIVED

CROSS-REFERENCE TO RELATED APPLICATION

This application claims priority to Korean Patent Application No. 10-2011-0069994, filed on Jul. 14, 2011, which is incorporated by reference herein in its entirety.

BACKGROUND OF THE INVENTION

1. Field of the Invention

The present invention relates to a flat panel display and, more particularly, to a flat panel display including a driving circuit in which a timing controller and a data driver for driving a panel are mounted on a single integrated circuit (IC), and a driving circuit thereof.

2. Description of the Related Art

A flat panel display (FPD) is a display device essential to implementing a compact and lightweight system such as portable computers, notebook computers, personal digital assistants (PDAs), or portable phone terminals, as well as monitors of desktop computers in the place of the conventional cathode ray tubes (CRTs). Currently commercialized flat panel displays include a liquid crystal display (LCD), a plasma display panel (PDP), an organic light emitting diode (OLED), and the like.

With reference to FIG. 1, an FPD generally has a structure including a timing controller receiving various signals from an external system 1 and generating control signals of a driver, gate and data drivers 6 and 7 generating a scan signal and an image signal corresponding to the signal generated by the timing controller 3, and a display panel 9 including gate lines GL and data lines DL disposed in a matrix form, receiving scan signals and image signals to control switching elements T to implement an image.

According to a high integration trend of an integrated circuit (IC), among driving circuits provided in the FPD having such a structure, a multiple drive IC (M-IC) in which the timing controller 3 and the data driver 7 are installed in a single IC has been proposed. FIG. 2 is a view illustrating a structure of an FPD including an M-IC.

With reference to FIG. 2, a plurality of M-ICs 3 are mounted on a printed circuit board (PCB), connected to an external system 1 to receive timing signals and an image signal, and connected to a gate driver 6 and a display panel 9 to generate control signals and to transmit processed and converted image signal.

As described above, the M-IC 3 is formed by installing an existing timing controller (3 in FIG. 1) and the data driver (7 in FIG. 1) in a single IC. A plurality of M-ICs 3*a*, 3*b*, and 3*c* are provided and each of the M-ICs 3*a*, 3*b*, and 3*c* has the same internal structure. An internal structure of the M-IC 3*a* will be described as an example. The M-IC 3*a* includes a clock generating unit 31*a* generating an internal clock signal of an IC itself, a synchronization signal generating unit 32*a* generating a synchronization signal when driving in fail-safe mode, a mode selector unit 33*a* for determining a driving mode according to a signal received from the external system 1, a signal processing unit 35*a* for timing signals and for processing and converting an image signal according to a determination of the mode selector unit 32, and a D-IC unit 37*a* for performing the same function as that of the existing data driver 7.

The FPD employing the M-IC 3 having such a structure is advantageous in that the number of provided ICs can be reduced and production costs can be reduced by simplifying the internal structure.

However, the FPD employing the M-IC 3 disadvantageously has a high possibility that no-signal driving of displaying a black screen on a screen is not smoothly performed when a signal is not received from the external system 1.

In detail, in the FPD employing the M-IC 3, all of the M-ICs 3*a*, 3*b*, and 3*c* are synchronized to be operated by timing signals applied from the external system 1, and if any one of a plurality of signals is not received from the external system 1, the respective M-ICs 3*a*, 3*b*, and 3*c* are changed to a fail-safe mode.

The fail-safe mode refers to a mode where the M-ICs 3*a*, 3*b*, and 3*c* operate to display a black screen by using an internal clock signal because a synchronization signal is not received. Since controls signal are not applied by the external system 1 in the fail-safe mode, the M-ICs 3*a*, 3*b*, and 3*c* are not synchronized, so they generates a synchronization signal by using an internal clock signal and display a black screen image (or blue screen image) according to the generated synchronization signal Here, the respective clock generation units 31*a*, 31*b*, and 31*c* included in the M-ICs 3*a*, 3*b*, and 3*c* have significant variations therebetween, and thus, frequencies of the synchronization signals generated by the respective M-ICs 3*a*, 3*b*, and 3*c* are not identical, failing to properly perform synchronization. Thus, in order to solve the synchronization problem, any one (M-IC 3*a*) of the respective M-ICs 3*a*, 3*b*, and 3*c* are set as a master and the other remaining M-ICs 3*b* and 3*c* are set as slaves. When they are driven in the fail-safe mode, a synchronization signal generated by the internal clock signal of the master M-IC 3*a* is shared to operate the mode selector units 32*b* and 32*c* of the slaves, as well as the mode selector unit 32*a* of the master to synchronize the respective M-ICs 3*a*, 3*b*, and 3*c*. A block image signal corresponding to a black screen is generated and output to D-IC units 37*a*, 37*b*, and 37*c*.

However, the M-ICs 3*a*, 3*b*, and 3*c* are mounted on a general PCB and share the synchronization signal of the master M-IC 3*a* through a line (PLINE) formed on the PCB. Thus, the M-ICs 3*a*, 3*b*, and 3*c* are affected by electrostatic discharge (ESD) or external noise, frequently causing the synchronization signal to be modulated.

Thus, in case of the fail-safe mode driving, the M-ICs malfunction, so the FPD having the related art M-ICs cannot display a black screen image.

SUMMARY OF THE INVENTION

An aspect of the present invention provides a flat panel display (FPD) including an M-IC which can be driven stably by resolving an error of a black screen displayed when driven in a fail-safe mode due to ESD, noise, or the like introduced from the outside.

According to an aspect of the present invention, there is provided a flat panel display (FPD) device including: a display panel having a plurality of pixels; a gate driver controlling the plurality of pixels; and a plurality of driving circuits processing and converting an image signal in a normal mode and outputting the same to the display panel when the image signal are received from an external system, and generating a black image signal according to a synchronization signal generated by an internal clock signal having the highest frequency among internal clock signals of the plurality of driving circuits, and outputting the same to the display panel when the image signal is not received.

Each of the plurality of driving circuits may include: a clock generating unit generating an internal clock signal; a synchronization signal generating unit performing counting by the internal clock signal, generating a synchronization signal when a count value reaches a threshold value, and outputting the generated synchronization signal to a different driving circuit; a mode selector unit determining a driving mode and generating a black image signal according to the synchronization signal; and a D-IC unit processing and converting the image signal or the black image signal and outputting the same to the display panel The plurality of driving circuits may include an external terminal connected an input/output terminal of the synchronization signal generating unit, receiving a pulled-up power source voltage in case of a normal mode, and outputting the synchronization signal in case of a fail-safe mode.

The external terminal may include: a first transistor having a base pulled up by a power source voltage by a first resistor, a collector to which the power source voltage is applied, and an emitter is pulled down by a ground voltage of a second resistor and connected to an input terminal of the synchronization signal generating unit; and a second transistor having a base connected to the synchronization signal generating unit, a collector connected to the base of the first transistor, and an emitter which is grounded.

The external terminal may further include a diode connected in parallel between the base of the first transistor and the emitter of the second transistor and the first resistor.

Each of the plurality of driving circuits may include: an interface receiving timing signals from the external system; and a signal controller for generating the timing signals and for processing and converting the image signal and outputting the same to the gate driver and the D-IC unit.

The synchronization signal may be a signal having a ground level.

According to another aspect of the present invention, there is provided a driving circuit of a flat panel display driven in a normal mode and a fail-safe mode according to whether or not an image signal is received, including: a clock generating unit generating an internal clock signal; a synchronization signal generating unit performing counting according to the internal clock signal, generating a synchronization signal when a count value reaches a threshold value, and outputting the generated synchronization signal to a different driving circuit, and receiving a synchronization signal from the different driving circuit; and a mode selector unit determining a driving mode and generating a black image signal according to the synchronization signal; and a D-IC unit processing and converting the black image signal and outputting the same to the display panel.

The driving circuit may further include: an external terminal connected to an input/output terminal of the synchronization signal generating unit, receiving a pulled-up power source voltage in case of a normal mode, and outputting the synchronization signal in case of a fail-safe mode.

The external terminal may include: a first transistor having a base pulled up by a power source voltage by a first resistor, a collector to which the power source voltage is applied, and an emitter is pulled down by a ground voltage of a second resistor and connected to an input terminal of the synchronization signal generating unit; a second transistor having a base connected to the synchronization signal generating unit, a collector connected to the base of the first transistor, and an emitter which is grounded; and a diode connected in parallel between the base of the first transistor and the emitter of the second transistor and the first resistor.

The foregoing and other objects, features, aspects and advantages of the present invention will become more apparent from the following detailed description of the present invention when taken in conjunction with the accompanying drawings.

DETAILED DESCRIPTION OF THE INVENTION

A flat panel display (FPD) according to an embodiment of the present invention is described herein with reference to the accompanying drawings.

Figure 3:
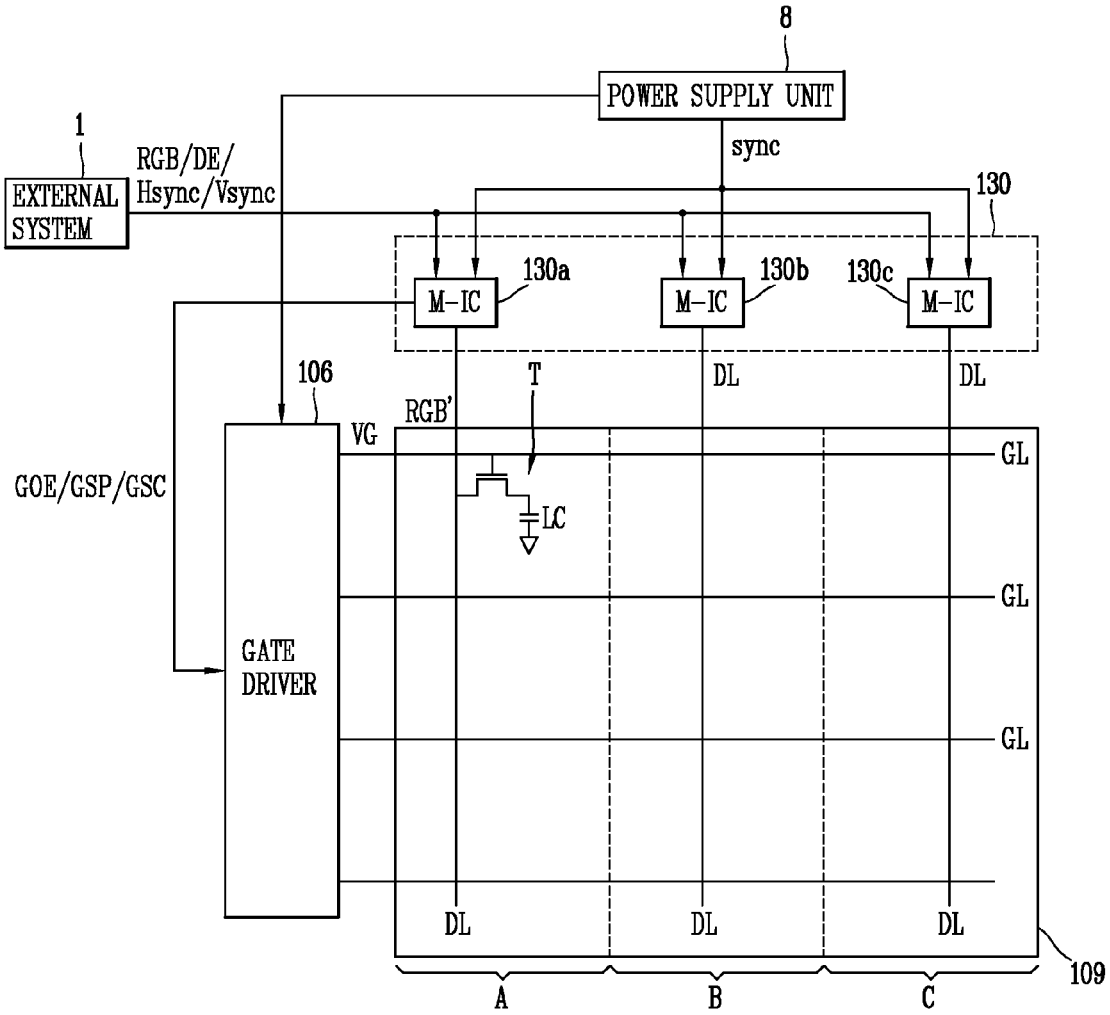
FIG. 3 is a view schematically showing an overall structure of an FPD according to an embodiment of the present invention.

FIG. 3 is a view schematically showing an overall structure of an FPD according to an embodiment of the present invention. As shown in FIG. 3, an FPD according to an embodiment of the present invention includes an M-IC 130 receiving various signals from an external system 1 and generating control signals and processing and converting an image signal, a gate driver 106 for generating a scan signal, and a display panel 109 for generating an image according to the scan signal and the image signal.

Figure 1:
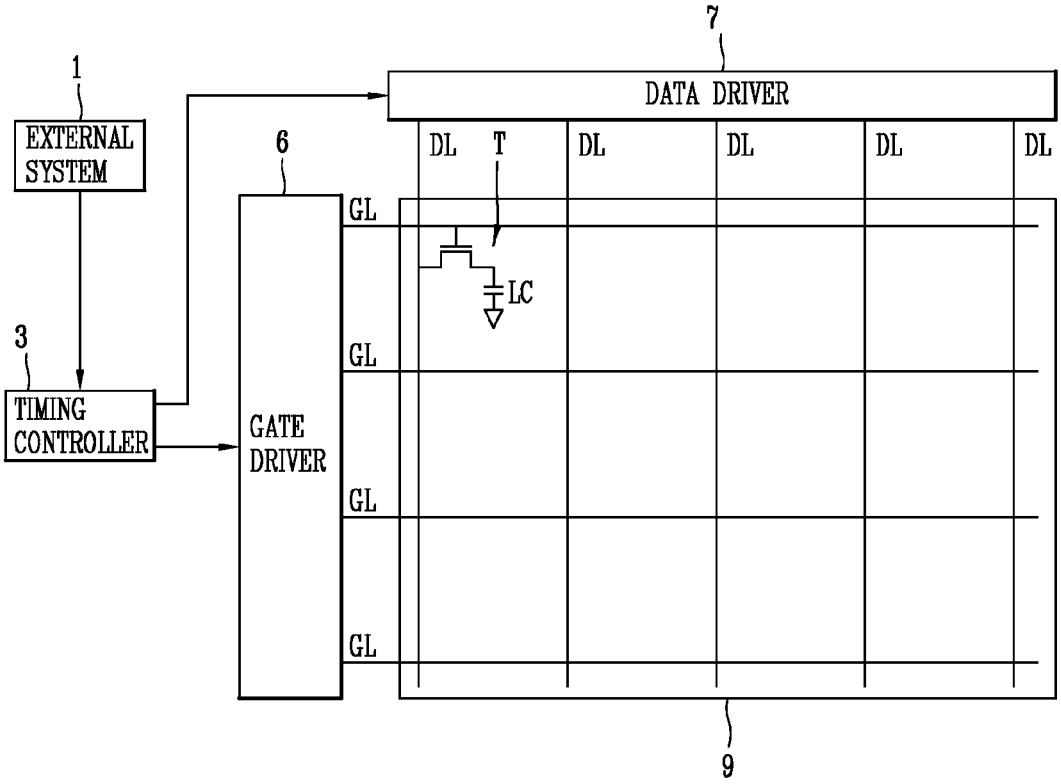
FIG. 1 is a view schematically showing a structure of a flat panel display (FPD).
Figure 2:
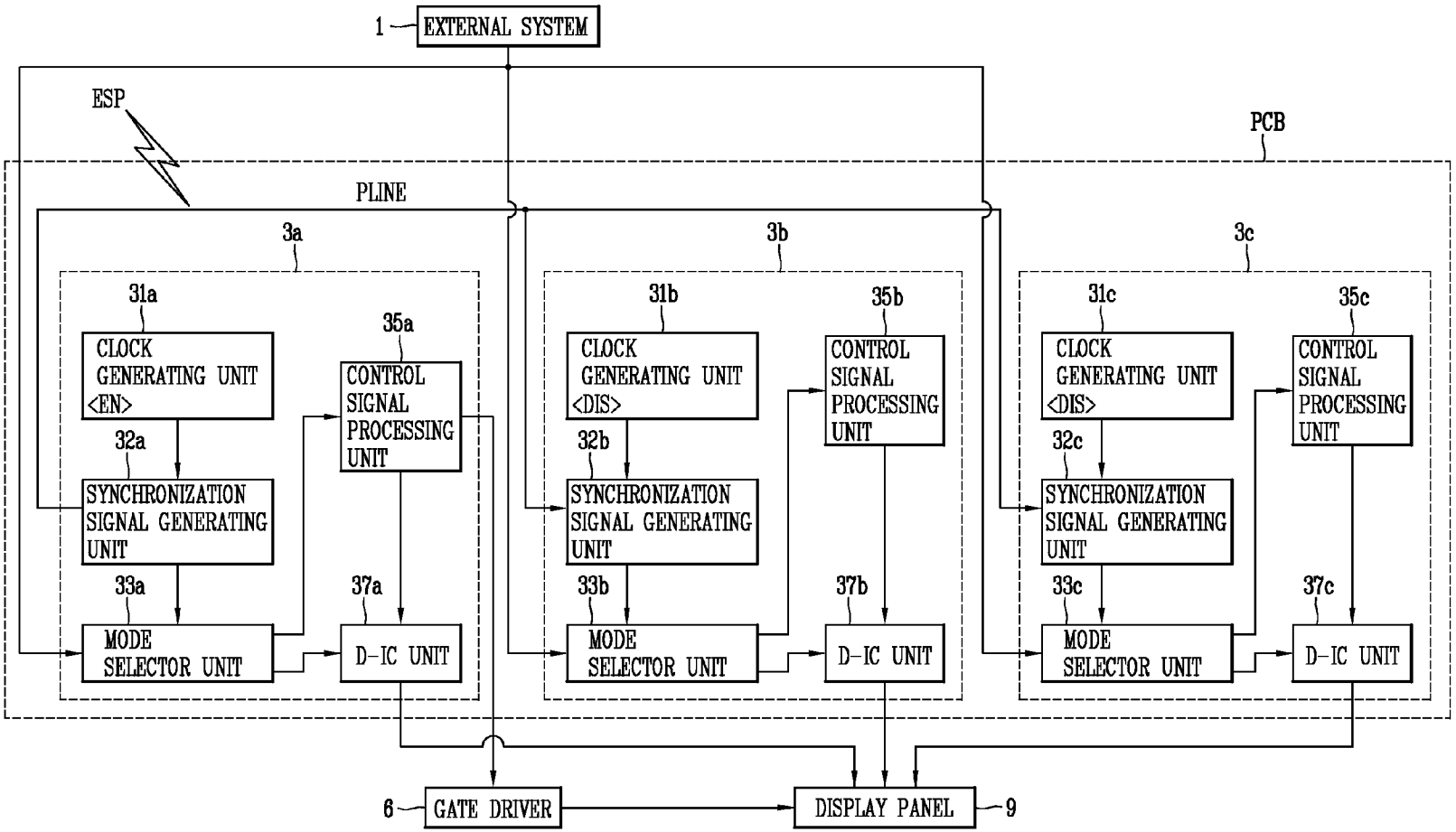
FIG. 2 is a view illustrating a structure of the FPD having M-ICs.

In detail, the M-IC 130 includes a timing controller and a data driver in a single integrated circuit (IC) and may perform the same function as the timing controller 3 in FIG. 1 and the data driver 7 in FIG. 1. In particular, a different number of data lines DL exist depending on the size of a display panel. Preferably, one or more M-ICs 130 are provided. In FIG. 3, an example in which three M-ICs 130*a*, 130*b*, and 130*c* corresponding to three regions A, B, and C of the display panel 109 are shown.

The M-IC 130 receives a data enable signal DE, a horizontal synchronization signal Hsync and a vertical synchronization signal Vsync (i.e., timing signals), and an image signal RGB from the external signal 1. The M-IC 130 processes and converts these signals.

First, the M-IC 130 generates a gate output signal GOE, a gate start pulse GPS, a gate shift clock GSC, control signals of the gate driver 106, and outputs the same to the gate driver 106.

Also, the M-IC 130 generates a source output signal SOE, a source start pulse SSP, a source shift clock SSC, a polarity control signal POL, control signals for generating an image signal. The M-IC 130 also processes and converts image signals RGB into an analog image signals RGB by using the generated signals. The M-IC 130 outputs the analog image signals RGB to the display panel 109.

The plurality of M-ICs 130*a*, 130*b*, and 130*c* as described above are synchronized by the synchronization signal Sync. A line for transmitting the synchronization signal Sync is connected to a power supply unit 8 to pull up the synchronization signal Sync to a power source voltage Vcc level. The line for transmitting the synchronization signal Sync is electrically connected to input and output terminals of the respective M-ICs 130*a*, 130*b*, and 130*c*. In case of normal driving, the signal pulled-up to the power source voltage Vcc is applied. Thereafter, when timing signals or an image signal are not input from the external system 1, a synchronization signal sync output by any one of the M-ICs 130*a*, 130*b*, and 130*c* is received and shared by the other remaining M-ICs. The structure of the M-IC 130 and the synchronization signal sync will be described below in detail.

The gate driver 106 controls ON/OFF operation of the switching elements T arranged on the display panel 109 according to the timing signals input from the M-IC 130. The gate driver 106 outputs a gate signal VG to sequentially enable the gate lines GL on the display panel 109 by one horizontal synchronization period each time to sequentially drive the switching elements T on the display panel 109 by one horizontal line each time to image signals output from the M-IC 130 to pixels connected to the respective switching elements.

In the display panel 109, a plurality of gate lines GL and a plurality of data lines DL cross in a matrix form to define a plurality of pixels at the respective crossings. The gate lines GL are connected to the gate driver 106, and the data lines DL are connected to the M-IC 130, and each pixel includes a switching element T. Thus, the switching element T is turned on or off according to signals input to the respective lines, and as image signals are applied to the pixels, an image is generated.

According to the foregoing structure, when the FPD according to an embodiment of the present invention is driven in a normal manner, the timing signals and the image signal are received from the external system 1 and processed and converted, and the gate driver 106 is controlled according to the signals to generate scan signals GL and turns on or off the switching elements on the display panel 109 to output image signals to the pixels to display an image.

Here, when receiving any one of the foregoing data enable signal DE, the horizontal synchronization signal Hsync, the vertical synchronization signal Vsync, and the image data RGB from the external system 1 are interrupted, namely, in case of a no-signal driving state where there is no image to be displayed by the FPD. Therefore, the M-IC 130 is changed to a fail-safe mode, not to a normal mode.

Also, when the FPD is driven in the normal mode, the M-ICs 130*a*, 130*b*, and 130*c* share the synchronization signal sync having a level pulled up to the power voltage Vcc in the synchronization signal input/output terminals. When the FPD is changed to the fail-safe mode, the M-ICs 130*a*, 130*b*, and 130*c* are driven by using internal clock signals generated by clock generating units installed in the respective M-ICs 130*a*, 130*b*, and 130*c*. Here, the respective M-ICs 130*a*, 130*b*, and 130*c* have a frequency offset among internal clock signals according to element characteristics thereof, a synchronization signal sync formed by an internal clock signal having the highest frequency is input as a synchronization signal sync to a different M-IC to implement synchronization among the M-ICs 130*a*, 130*b*, and 130*c*.

For example, when it is assumed that the frequency of the internal clock signal of the M-IC 130*a*, a synchronization signal sync generated by the internal clock signal of the M-IC 130*a* is input to the other M-ICs 130*b* and 130*c* to perform synchronization. This is implemented by connecting the synchronization signal input/output terminals of the M-ICs 130*a*, 130*b*, and 130*c*, and the connection of the terminals of the M-ICs 130*a*, 130*b*, and 130*c* will be described in detail later.

According to such a structure, the FPD according to an embodiment of the present invention can display a stable black screen even in the fail-safe mode in a no-signal state by overcoming a synchronization problem arising due to different internal clock signals among the plurality of M-ICs due to ESD, noise, or the like, introduced from the outside. A driving circuit of the FPD according to an embodiment of the present invention will be described with reference to the accompanying drawings.

Figure 4:
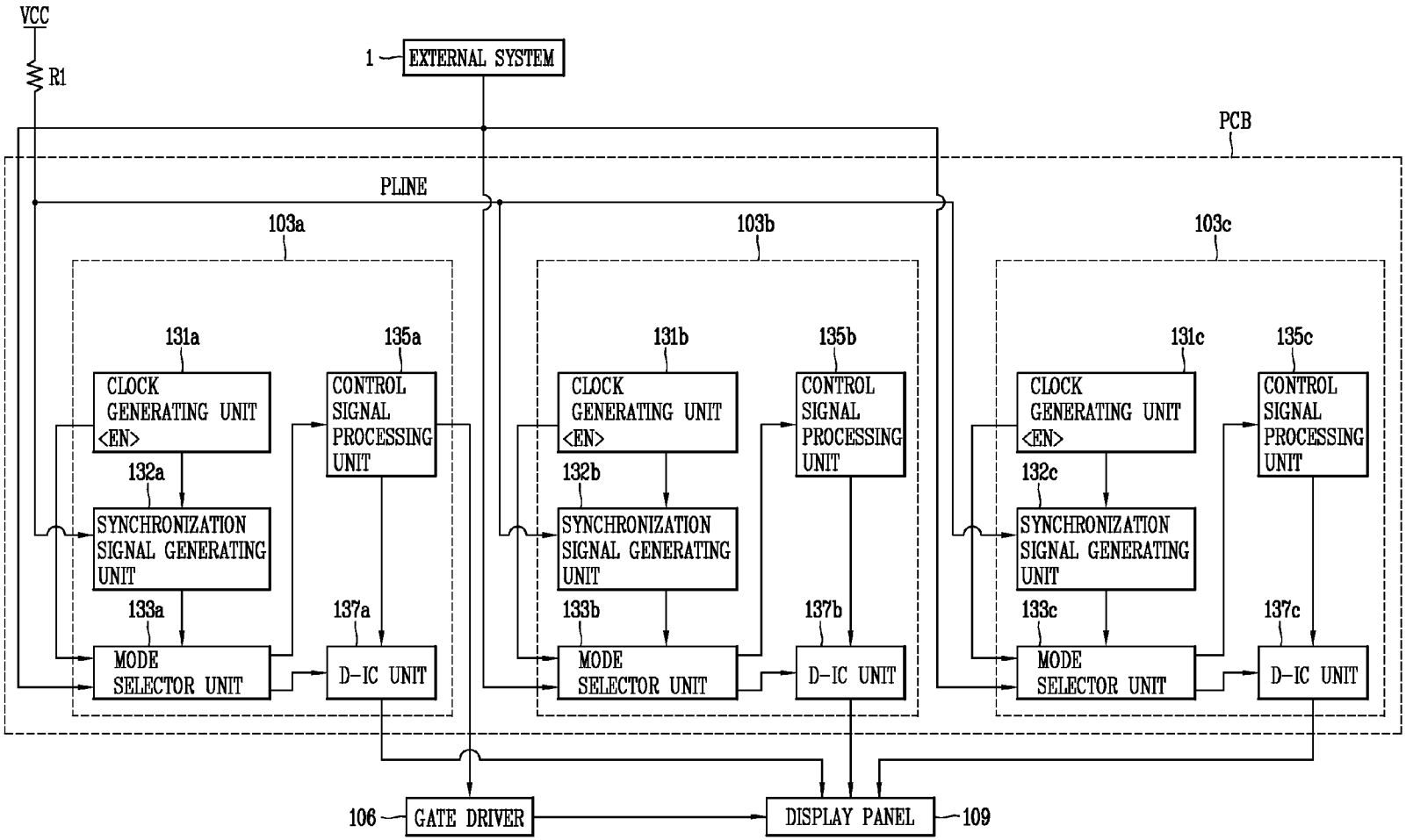
FIG. 4 is a view showing a connection structure of the M-ICs according to an embodiment of the present invention.

FIG. 4 is a view showing a connection structure of the M-ICs according to an embodiment of the present invention. As illustrated, a plurality of M-ICs 103 are mounted on a PCB and connected to the external system 1 to receive timing signals and an image signal. Also, control signals are generated and the image signal are processed and converted, and then, output to the connected gate driver 106 and the display panel 109.

The M-ICs 103 have the same internal structure and include a plurality of ICs. An internal structure of the M-IC 103*a* will be described as an example. The M-IC 103*a* includes a clock generating unit 131*a* for generating an internal clock signal of its own, a synchronization signal generating unit 132*a* for generating a synchronization signal by using the internal clock signal in a fail-safe mode, a mode selector unit 133*a* for determining a driving mode according to whether or not a signal is received from an external system 1 and generating a black image signal according to a synchronization signal, a signal processing unit 135*a* for processing and converting input control signals, and a D-IC unit 137*a* for outputting the received image signal and the black image signal generated by the mode selector unit 132*a* to the display panel 109.

In detail, the M-IC 103 determines a normal mode or a fail-safe mode depending on whether or not timing signals and an image signal are received from the external system 1. A driving method based on the M-IC 103*a* will be described. When the M-IC 103*a* is driven in a normal mode, the mode selector unit 132*a* of the M-IC 103*a* receives timing signals and an image signal from the external system 1 and outputs the control signals to the signal processing unit 135*a* and outputs the image signal to the D-IC unit 137*a*. Here, the M-IC 130*a* and the other M-ICs 103*b* and 130*c* are operated in synchronization with the received control signal.

The signal processing unit 135*a* processes and converts the input control signals to generate control signals for controlling the gate driver 106 and the D-IC unit 137*a* and outputs the generated control signals to the gate driver 106 and the D-IC unit 137*a*.

The D-IC unit 137*a* generates an analog image signal of a corresponding horizontal line portion at every one horizontal period of the display panel 109 and outputs the same to the display panel 109. Accordingly, the switching elements provided in the display panel 109 are activated according to the control signals and an image according to the input image signal is implemented.

Also, when the M-IC 103*a* is driven in the fail-safe mode, the M-IC 103*a* does not receive at least any one of control signals and an image signal from the external system 1. The synchronization signal generating unit 132*a* of the M-IC 103 generates a synchronization signal sync upon receiving an internal clock signal of the clock generating unit 131*a*. The mode selector unit 132*a* generates control signals and a black image signal FDE according to the synchronization signal Sync.

Here, an input/output terminal of the synchronization signal generating unit 132*a* is pulled up by the power source voltage Vcc by a first resistor R1, and thus, in the normal mode, the synchronization signal sync maintains the power voltage level. Meanwhile, in the fail-safe mode, the synchronization signal sync is controlled according to an output from the synchronization signal generating unit 132*a*.

The synchronization signal generating unit 132*a* generates a synchronization signal corresponding to a frequency of the input internal clock signal, and here, a synchronization signal generated by an internal clock signal having the highest frequency among the M-IC 103*a* and the other M-ICs 103*b* and 103*c* is input to the other M-ICs. For example, when it is assumed that the internal clock signal of the M-IC 103*a* has the highest frequency, the synchronization signal sync generated by the M-IC 103*a* is used as a synchronization signal sync of the other M-ICs 103*b* and 130*c*. This is because, since the black image signal FDE is generated in proportion to a count value with respect to a low level of the synchronization signal Sync, and when the frequency of the internal clock signal is low, the counter value is so small during the same period that a sufficient period for generating the black image signal FDE cannot be secured.

Figure 5:
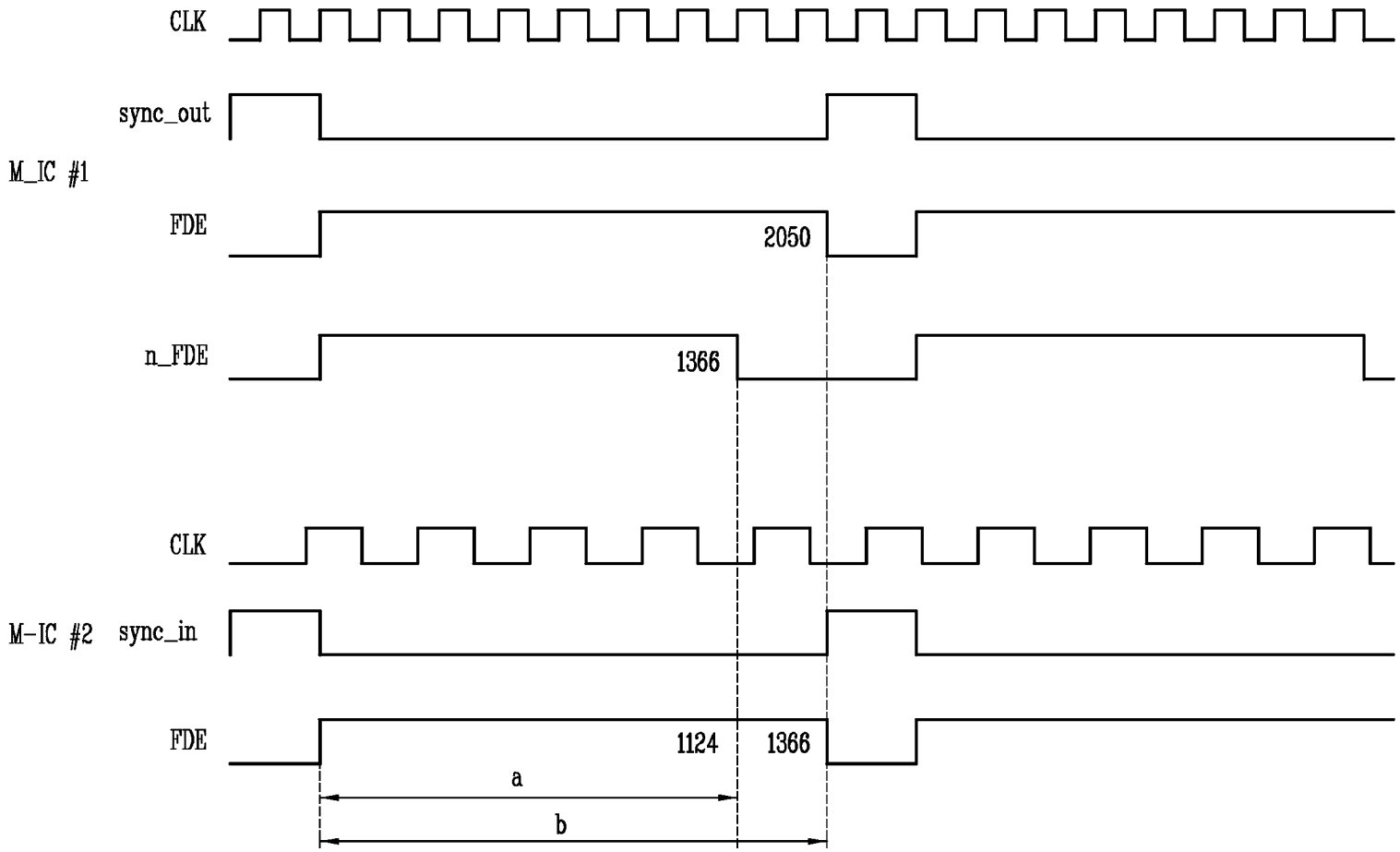
FIG. 5 is a view showing an example of waveforms relative to a synchronization signal and a black image signal of the M-IC according to an embodiment of the present invention.

FIG. 5 is a view showing an example of waveforms relative to the synchronization signal and the black image signal of the M-IC according to an embodiment of the present invention. In FIG. 5, signal waveforms of two M-IC internal clock signals (CLK) having a frequency offset of about 20% are compared.

As illustrated, in comparison of a black image signal FDE generated by the first M-IC having a clock frequency of 84 MHz and that generated by the second M-IC having a clock frequency of 56 MHz, it can be seen that the first M-IC generates a block image signal FDE having a width of 2050, a counter value during a low level period of a synchronization signal sync_out while the second M-IC generates a black image signal FDE having a width of 1366, a counter value during a low level period of a synchronization signal sync_in, during the same period.

In case of a liquid crystal display having horizontal resolution of 1366, data with respect to at least 1366 pixels is required for one horizontal line, and the first M-IC can generate the black image signal n_FDE of the required waveform during a period (a). However, the second M-IC requires a period (b) delayed in comparison to the period (a) in order to generate data with respect to 1366 pixels, and thus, the first M-IC can generate merely data with respect to 1124 pixels during the same period as that of the black image signal n_FDE, data with respect to the 1366 pixels.

Thus, in an embodiment of the present invention, the synchronization signal sync_out generated by the M-IC whose internal clock signal has the highest frequency is used as a synchronization signal sync_in of the other M-ICs.

An internal structure of the M-IC and signals input and output between respective components according to an embodiment of the present invention will be described in detail.

Figure 6:
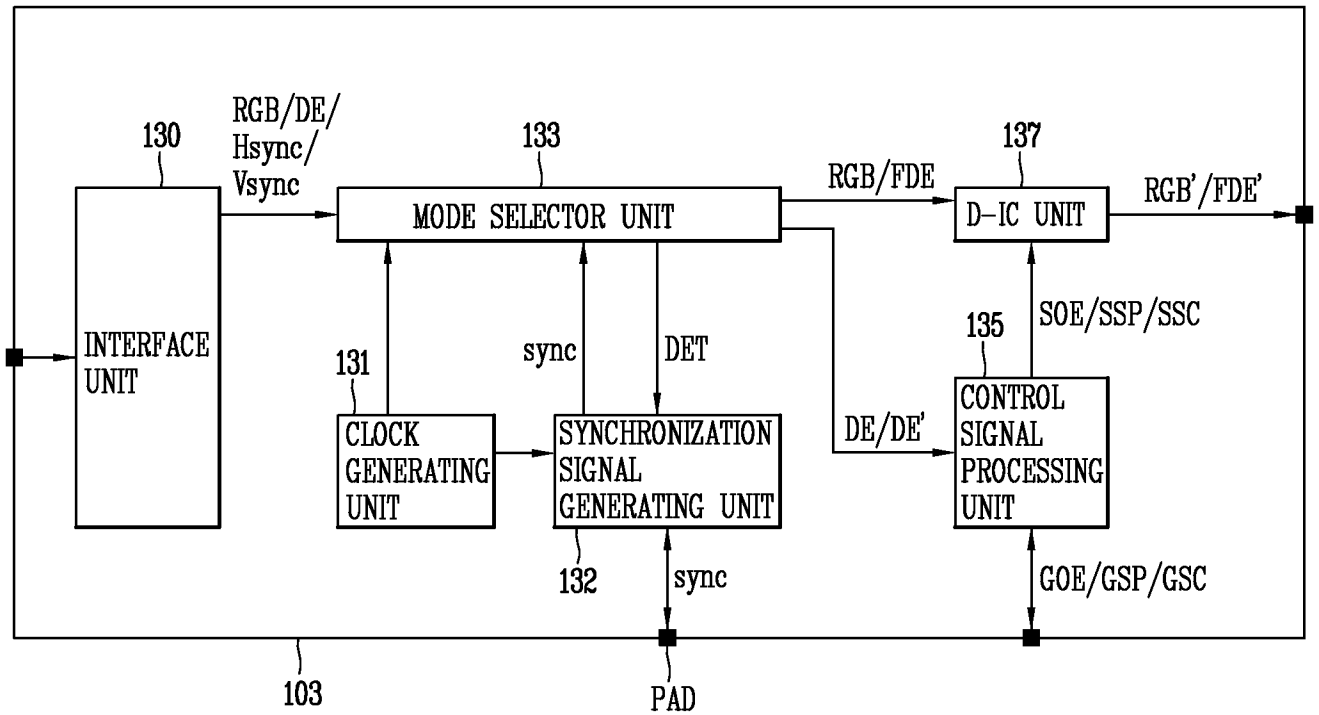
FIG. 6 is a view showing connection configuration of the M-IC of the FPD and a signal flow according to an embodiment of the present invention.

FIG. 6 is a view showing connective configuration of the M-IC of the FPD and a signal flow according to an embodiment of the present invention. As illustrated, the M-IC according to an embodiment of the present invention includes an interface 130, a clock generating unit 131, a synchronization signal generating unit 132, a mode selector unit 133, a control signal processing unit 135, and a D-IC unit 137. Also, some of the respective components are connected to an external terminal PAD.

First, the interface 130 receives an image signal RGB and timing signals including a data enable signal DE, a horizontal synchronization signal Hsync, a vertical synchronization signal Vsync, and the like, from an external system such as a personal computer, or the like, and outputs the same to the mode selector unit 133. An LVDS (Low Voltage Differential Signal) scheme, a mini-LVDS scheme, or the like, is applied to the interface 130.

The clock generating unit 131 generates an internal clock signal CLK of the M-IC 103, and when the M-IC 103 is driven in the fail-safe mode, the clock generating unit 131 provides the internal clock signal CLK to the synchronization signal generating unit 132 and the mode selector unit 133. The clock generating unit 131 is configured as a general oscillator.

When the M-IC 103 is driven in the fail-safe mode, the synchronization signal generating unit 132 receives the internal clock signal CLK generated by the clock generating unit 131 and generates a synchronization signal sync. Here, an input/output terminal of the synchronization signal generating unit 132 is connected to external terminal PAD to maintain a pull-up state with the power source voltage Vcc level in case of a normal mode, and in case of the fail-safe mode, the synchronization signal generating unit 132 outputs the synchronization signal sync according to the internal clock signal through the external terminal PAD so as to be synchronized with the other M-ICs by the signal.

The mode selector 133 receives the timing signal DE and the image signal RGB from the external system 1, outputs the control signal to the signal processing unit 135, and outputs the image signal RGB to the D-IC unit 137.

When the interface 130 fails to receive at least one of the image signal RGB, the data enable signal DE, the horizontal synchronization signal Hsync, and the vertical synchronization signal Vsync, the mode selector unit 133 recognizes a fail-safe mode, receives a synchronization signal sync applied from the synchronization signal generation unit 132, outputs a timing signal DE' for driving in a fail-safe mode to the signal processing unit 135, outputs a detect signal DET to the synchronization signal generating unit 132*a*, and generates a black image signal FDE and outputs the same to the D-IC unit 137.

The signal processing unit 135 processes and processes the input timing signal DE or DE' to generate a gate output signal GOE, a gate start pulse GSP, and a gate shift clock GSC for controlling the gate driver through the external terminal PAD, and outputs them through the external terminal PAD. Also, the signal processing unit 135 generates a source output signal SOE, a source start pulse SSP, and a source shift clock SSC for controlling the D-IC unit 137, and outputs the same to the D-IC unit 137.

According to the control signal input to the D-IC unit 137, an image signal RGB' or the black image signal FDE' for one horizontal line at every one horizontal period of the display panel, and output the same through the external terminal PAD.

According to the foregoing structure, according to an embodiment of the present invention, in case of normal mode driving, the image signal RGB is processed and converted according to the received data enable signal DE to display an image. In case of fail-safe mode driving, a synchronization signal sync is generated through an internal clock signal and a black image signal FDE is generated according to a frequency thereof to implement a black screen image. Hereinafter, the structure of one M-IC provided in the FPD and a driving method thereof will be described in detail with reference to the accompanying drawings.

Figure 7:
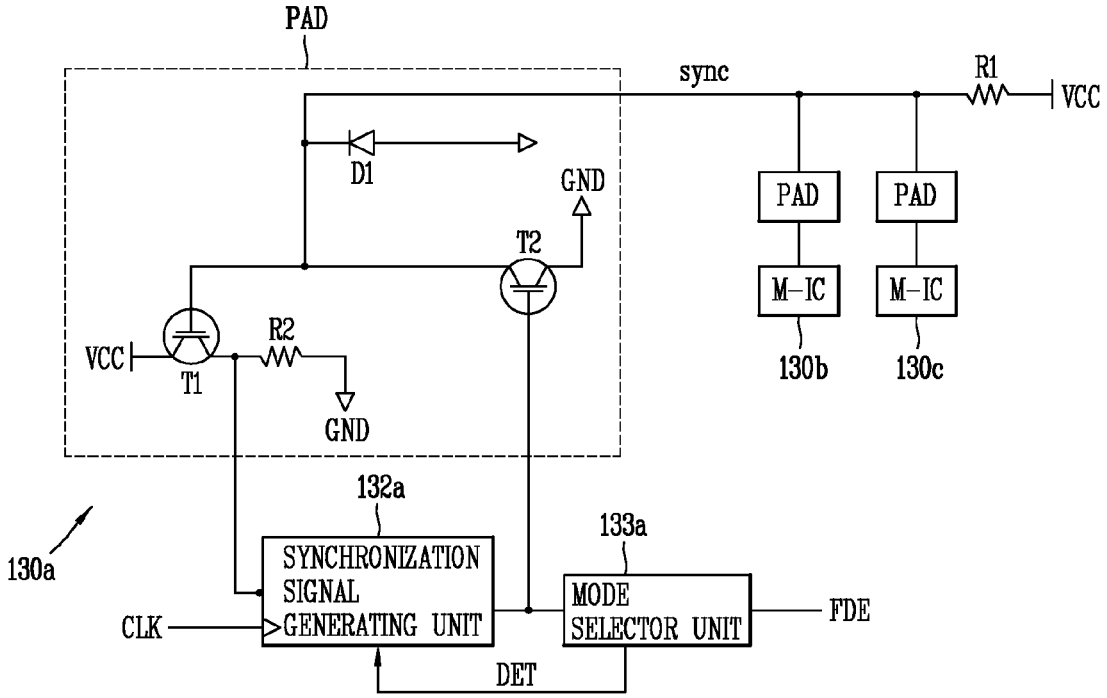
FIG. 7 is a view showing a connection configuration of a synchronization signal generating unit of an M-IC and the structure of a pad part connected to each M-IC in the FPD according to an embodiment of the present invention.

FIG. 7 is a view showing a connection configuration of a synchronization signal generating unit of an M-IC and the structure of a pad part connected to each M-IC in the FPD according to an embodiment of the present invention. In FIG. 7, only the connection configuration of one M-IC 130*a*, but the connection configurations of the other M-ICs 130*b* and 130*c* have the same structure.

As illustrated, the M-IC 130*a* includes the synchronization signal generating unit 132*a* and the mode selector unit 133*a*, and input/output terminal of the synchronization signal generating unit 132*a* is connected to the external terminal PAD.

The external terminal PAD includes at least two transistors T1 and T2, a diode D1, and a second resistor R2. The transistors T1 and T2 are connected to an input terminal and an output terminal of the synchronization signal generating unit 132, respectively. In detail, in the first transistor T1 of the external terminal PAD, a power source voltage Vcc pulled up by the first resistor R1 is applied to a base, the power source voltage is applied to a collector, and an emitter is pulled down to a ground voltage GND by the second resistor R2. Also, the emitter is connected to the input terminal of the synchronization signal generating unit 132*a*.

Also, in the second transistor T2 of the external terminal PAD, a base is connected to the output terminal of the synchronization signal generating unit 132*a*, the power source voltage Vcc pulled up by the first resistor R1 is applied to the collector. Thus, the collector is electrically connected to the base of the first transistor T1. An emitter is grounded.

The diode D1 is connected in parallel in a reverse direction between the base of the first transistor T1 and the collector of the second transistor T2 and the power source voltage Vcc to prevent a voltage between the respective external terminals PADs from being lowered to below a ground voltage GND level.

As for the driving of the M-IC having the foregoing connection structure, first, in case of normal mode driving, the power-source voltage Vcc is pulled up and applied to the first transistor T1. Accordingly, the first transistor T1 is turned on and the power source voltage Vcc is applied to the input terminal of the synchronization signal generating unit 132*a*, so a black image signal FDE is not generated. Thus, all the M-ICs 130*a*, 130*b*, and 130*c* share a high level synchronization signal sync.

In case of fail-safe mode driving, the mode selector unit 133*a* transmits a detect signal DET indicating the fail-safe mode to the synchronization signal generating unit 132*a*, and the synchronization signal generating unit 132*a* starts to count up to a threshold value according to an input internal clock signal CLK. Accordingly, when the high level synchronization signal sync is output by the synchronization signal generating unit 132*a* which has completed counting, among all the synchronization signal generating units, it is applied to the base terminal of the second transistor T2 to electrically connect the second transistor T2, and accordingly, the ground voltage GND is applied to the base terminal of the first transistor T1 to interrupt the first transistor T1. Namely, an output signal s-out of the synchronization signal generating unit 132*a* of the M-IC 130*a* which has completed counting becomes an input signal s-in of the other M-ICs 130*b* and 130*b*. To this end, the synchronization signal generating unit 132*a* may be implemented as a general counter circuit.

Accordingly, a low level synchronization signal sync is input to the synchronization signal generating units of the other M-IC 130*b* and 130*c* to complete counting, and the mode selector unit generates a black image signal FDE corresponding to the counter value and outputs the same. Accordingly, all the M-IC are synchronized.

While the present invention has been shown and described in connection with the embodiments, it will be apparent to those skilled in the art that modifications and variations can be made without departing from the spirit and scope of the invention as defined by the appended claims.

What is claimed is:

1. A flat panel display (FPD) device comprising:

a display panel having a plurality of pixels;

a gate driver controlling the plurality of pixels; and a plurality of driving circuits processing and converting an image signal for outputting to the display panel in a normal mode when timing signals and the image signal are received from an external system, and generating a black image signal according to a synchronization signal when the timing signals or the image signal is not received from the external system, each of the plurality of driving circuits comprising:

a clock generating unit generating an internal clock signal, a synchronization signal generating unit configured to:

perform counting based on the internal clock signal, generate an output signal as the synchronization signal of other driving circuits of the plurality of driving circuits when the internal clock signal of the driving circuit has the highest frequency among internal clock signals of the plurality of driving circuits, and receive an output from another driving circuit of the plurality of driving circuits as the synchronization signal when an internal clock of the other driving circuit has the highest frequency among the plurality of driving circuits; and a mode selector unit connected to the synchronization signal generation unit to receive the synchronization signal, the mode selector configured to determine a driving mode and generate the black image signal according to the synchronization signal.

2. The device of claim 1, wherein the synchronization signal generating unit generating a synchronization signal when a count value reaches a threshold value, and the device further comprising a D-IC unit processing and converting the image signal or the black image signal and outputting the image signal or the black image to the display panel.

3. The device of claim 2, wherein the plurality of driving circuits comprise:

an external terminal connected an input/output terminal of the synchronization signal generating unit, receiving a pulled-up power source voltage in case of a normal mode, and outputting the synchronization signal in case of a fail-safe mode.

4. The device of claim 3, wherein the external terminal comprises:

a first transistor having a base pulled up by a power source voltage by a first resistor, a collector to which the power source voltage is applied, and an emitter is pulled down by a ground voltage of a second resistor and connected to an input terminal of the synchronization signal generating unit; and a second transistor having a base connected to the synchronization signal generating unit, a collector connected to the base of the first transistor, and an emitter which is grounded.

5. The device of claim 4, wherein the external terminal further comprises:

a diode connected in parallel between the base of the first transistor and the emitter of the second transistor and the first resistor.

6. The device of claim 2, wherein each of the plurality of driving circuits comprises:

an interface receiving the timing signals and the image signal from the external system; and a signal controller for generating the control signals and for processing and converting the image signal and outputting the converted image signal to the gate driver and the D-IC unit.

7. The device of claim 1, wherein the synchronization signal is a signal having a ground level.

8. A driving circuit of a flat panel display driven in a normal mode or a fail-safe mode depending on whether timing signals and an image signal are received, the driving circuit comprising:

an interface receiving the timing signal and the image signal;

a clock generating unit generating an internal clock signal;

a synchronization signal generating unit (i) generating an output as a synchronization signal when a count value based on the internal clock signal reaching a threshold value, (ii) outputting the generated synchronization signal to other driving circuits when the internal clock signal has a frequency higher than frequencies of internal clocks signals in the other driving circuits, and (iii) receiving an output from another driving circuit as the synchronization signal when the internal clock signal has a frequency not higher than frequencies of internal clocks signals in the other driving circuits;

a mode selector unit connected to the synchronization signal generation unit to receive the synchronization signal, the mode selector unit determining a driving mode and generating a black image signal according to the synchronization signal; and a D-IC unit processing and converting the black image signal and outputting the same to the display panel.

9. The driving circuit of claim 8, further comprising:

an external terminal connected an input/output terminal of the synchronization signal generating unit, receiving a pulled-up power source voltage in case of a normal mode, and outputting the synchronization signal in case of a fail-safe mode.

10. The driving circuit of claim 9, wherein the external terminal comprises:

a first transistor having a base pulled up by a power source voltage by a first resistor, a collector to which the power source voltage is applied, and an emitter pulled down by a ground voltage of a second resistor and connected to an input terminal of the synchronization signal generating unit;

a second transistor having a base connected to the synchronization signal generating unit, a collector connected to the base of the first transistor, and an emitter which is grounded; and a diode connected in parallel between the base of the first transistor and the emitter of the second transistor and the first resistor.

* * * * *